US007342592B2

(12) United States Patent
Feng

(10) Patent No.: US 7,342,592 B2
(45) **Date of Patent: *Mar. 11, 2008**

(54) SYSTEM FOR REDUCING CROSSTALK

(75) Inventor: Xiao-fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/330,956

(22) Filed: Jan. 11, 2006

(65) Prior Publication Data

US 2006/0132511 A1 Jun. 22, 2006

Related U.S. Application Data

(62) Division of application No. 10/867,958, filed on Jun. 14, 2004, now Pat. No. 7,023,451.

(51) Int. Cl.
*G09G 5/02* (2006.01)

(52) U.S. Cl. ..... 345/600; 345/613; 345/601; 345/604; 345/204

(58) Field of Classification Search ..... 345/600, 345/613, 601, 604, 204
See application file for complete search history.

(56) References Cited

U.S. PATENT DOCUMENTS

| | | | |
|---|---|---|---|
| 3,329,474 | A | 7/1967 | Harris et al. |
| 3,375,052 | A | 3/1968 | Kosanke et al. |
| 3,428,743 | A | 2/1969 | Hanlon |
| 3,439,348 | A | 4/1969 | Harris et al. |
| 3,499,700 | A | 3/1970 | Harris et al. |
| 3,503,670 | A | 3/1970 | Kosanke et al. |
| 3,554,632 | A | 1/1971 | Chitayat |
| 3,947,227 | A | 3/1976 | Granger et al. |
| 4,012,116 | A | 3/1977 | Yevick |
| 4,110,794 | A | 8/1978 | Lester et al. |
| 4,170,771 | A | 10/1979 | Bly |
| 4,385,806 | A | 5/1983 | Fergason |
| 4,410,238 | A | 10/1983 | Hanson |
| 4,441,791 | A | 4/1984 | Hornbeck |
| 4,516,837 | A | 5/1985 | Soref et al. |
| 4,540,243 | A | 9/1985 | Fergason |
| 4,562,433 | A | 12/1985 | Biferno |
| 4,574,364 | A | 3/1986 | Tabata et al. |
| 4,611,889 | A | 9/1986 | Buzak |

(Continued)

FOREIGN PATENT DOCUMENTS

| | | |
|---|---|---|
| EP | 0 732 669 A1 | 9/1996 |

(Continued)

OTHER PUBLICATIONS

Ngai-Man Cheung, et al., "Configurable entropy coding scheme for H.26L," ITU-Telecommunications Standardization Sector, Study Group 16 Question 6 Video Coding Experts Group (VCEG), Twelfth Meeting: Eibsee, Germany, Jan. 9-12, 2001, pp. 1-11.

(Continued)

*Primary Examiner*—Matthew C. Bella
*Assistant Examiner*—Mike Rahmjoo
(74) *Attorney, Agent, or Firm*—Chernoff, Vilhauer, McClung & Stenzel

(57) ABSTRACT

A system for reducing crosstalk for a display.

31 Claims, 4 Drawing Sheets

U.S. PATENT DOCUMENTS

| | | | |
|---|---|---|---|
| 4,648,691 | A | 3/1987 | Oguchi et al. |
| 4,649,425 | A | 3/1987 | Pund |
| 4,682,270 | A | 7/1987 | Whitehead et al. |
| RE32,521 | E | 10/1987 | Fergason |
| 4,715,010 | A | 12/1987 | Inoue et al. |
| 4,719,507 | A | 1/1988 | Bos |
| 4,755,038 | A | 7/1988 | Baker |
| 4,758,818 | A | 7/1988 | Vatne |
| 4,766,430 | A | 8/1988 | Gillette et al. |
| 4,834,500 | A | 5/1989 | Hilsum et al. |
| 4,862,270 | A | 8/1989 | Nishio |
| 4,862,498 | A | 8/1989 | Kelly et al. |
| 4,885,783 | A | 12/1989 | Whitehead et al. |
| 4,888,690 | A | 12/1989 | Huber |
| 4,910,413 | A | 3/1990 | Tamune |
| 4,917,452 | A | 4/1990 | Liebowitz |
| 4,933,754 | A | 6/1990 | Reed et al. |
| 4,954,789 | A | 9/1990 | Sampsell |
| 4,958,915 | A | 9/1990 | Okada et al. |
| 4,969,717 | A | 11/1990 | Mallinsoh |
| 4,981,838 | A | 1/1991 | Whitehead |
| 4,991,924 | A | 2/1991 | Shankar et al. |
| 5,012,274 | A | 4/1991 | Dolgoff |
| 5,013,140 | A | 5/1991 | Healey et al. |
| 5,074,647 | A | 12/1991 | Fergason et al. |
| 5,075,789 | A | 12/1991 | Jones et al. |
| 5,083,199 | A | 1/1992 | Borner |
| 5,122,791 | A | 6/1992 | Gibbons et al. |
| 5,128,782 | A | 7/1992 | Wood |
| 5,138,449 | A | 8/1992 | Kerpchar |
| 5,144,292 | A | 9/1992 | Shiraishi et al. |
| 5,164,829 | A | 11/1992 | Wada |
| 5,168,183 | A | 12/1992 | Whitehead |
| 5,187,603 | A | 2/1993 | Bos |
| 5,202,897 | A | 4/1993 | Whitehead |
| 5,206,633 | A | 4/1993 | Zalph |
| 5,214,758 | A | 5/1993 | Ohba et al. |
| 5,222,209 | A | 6/1993 | Murata et al. |
| 5,247,366 | A | 9/1993 | Ginosar et al. |
| 5,256,676 | A | 10/1993 | Hider et al. |
| 5,300,942 | A | 4/1994 | Dolgoff |
| 5,305,146 | A | 4/1994 | Nakagaki et al. |
| 5,311,217 | A | 5/1994 | Guerin et al. |
| 5,313,225 | A | 5/1994 | Miyadera |
| 5,313,454 | A | 5/1994 | Bustini et al. |
| 5,317,400 | A | 5/1994 | Gurley et al. |
| 5,339,382 | A | 8/1994 | Whitehead |
| 5,357,369 | A | 10/1994 | Pilling et al. |
| 5,359,345 | A | 10/1994 | Hunter |
| 5,369,266 | A | 11/1994 | Nohda et al. |
| 5,369,432 | A | 11/1994 | Kennedy |
| 5,386,253 | A | 1/1995 | Fielding |
| 5,394,195 | A | 2/1995 | Herman |
| 5,395,755 | A | 3/1995 | Thorpe et al. |
| 5,416,496 | A | 5/1995 | Wood |
| 5,422,680 | A | 6/1995 | Lagoni et al. |
| 5,426,312 | A | 6/1995 | Whitehead |
| 5,436,755 | A | 7/1995 | Gueria |
| 5,450,498 | A | 9/1995 | Whitehead |
| 5,461,397 | A | 10/1995 | Zhang et al. |
| 5,471,225 | A | 11/1995 | Parks |
| 5,471,228 | A | 11/1995 | Ilcisin et al. |
| 5,477,274 | A | 12/1995 | Akiyoshi et al. |
| 5,481,637 | A | 1/1996 | Whitehead |
| 5,570,210 | A | 10/1996 | Yoshida et al. |
| 5,579,134 | A | 11/1996 | Lengyel |
| 5,580,791 | A | 12/1996 | Thorpe et al. |
| 5,592,193 | A | 1/1997 | Chen |
| 5,617,112 | A | 4/1997 | Yoshida et al. |
| 5,642,015 | A | 6/1997 | Whitehead et al. |
| 5,642,128 | A | 6/1997 | Inoue |
| D381,355 | S | 7/1997 | Frank-Braun |
| 5,650,880 | A | 7/1997 | Shuter et al. |
| 5,652,672 | A | 7/1997 | Huignard et al. |
| 5,661,839 | A | 8/1997 | Whitehead |
| 5,682,075 | A | 10/1997 | Bolleman et al. |
| 5,684,354 | A | 11/1997 | Gleckman |
| 5,689,283 | A | 11/1997 | Shirochi |
| 5,715,347 | A | 2/1998 | Whitehead |
| 5,717,422 | A | 2/1998 | Fergason |
| 5,729,242 | A | 3/1998 | Margerum et al. |
| 5,754,159 | A | 5/1998 | Wood et al. |
| 5,767,837 | A | 6/1998 | Hara |
| 5,784,181 | A | 7/1998 | Loiseaux et al. |
| 5,796,382 | A | 8/1998 | Beeteson |
| 5,854,662 | A | 12/1998 | Yuyama et al. |
| 5,886,681 | A | 3/1999 | Walsh et al. |
| 5,889,567 | A | 3/1999 | Swanson et al. |
| 5,892,325 | A | 4/1999 | Gleckman |
| 5,901,266 | A | 5/1999 | Whitehead |
| 5,939,830 | A | 8/1999 | Praiswater |
| 5,940,057 | A | 8/1999 | Lien et al. |
| 5,959,777 | A | 9/1999 | Whitehead |
| 5,969,704 | A | 10/1999 | Green et al. |
| 5,978,142 | A | 11/1999 | Blackham et al. |
| 5,986,628 | A | 11/1999 | Tuenge et al. |
| 5,995,070 | A | 11/1999 | Kitada |
| 5,999,307 | A | 12/1999 | Whitehead et al. |
| 6,008,929 | A | 12/1999 | Akimoto et al. |
| 6,024,462 | A | 2/2000 | Whitehead |
| 6,025,583 | A | 2/2000 | Whitehead |
| 6,043,591 | A | 3/2000 | Gleckman |
| 6,050,704 | A | 4/2000 | Park |
| 6,064,784 | A | 5/2000 | Whitehead et al. |
| 6,079,844 | A | 6/2000 | Whitehead et al. |
| 6,111,559 | A | 8/2000 | Motomura et al. |
| 6,111,622 | A | 8/2000 | Abileah |
| 6,120,588 | A | 9/2000 | Jacobson |
| 6,120,839 | A | 9/2000 | Comiskey et al. |
| 6,129,444 | A | 10/2000 | Tognoni |
| 6,160,595 | A | 12/2000 | Kishimoto |
| 6,172,798 | B1 | 1/2001 | Albert et al. |
| 6,211,851 | B1 | 4/2001 | Lien et al. |
| 6,215,920 | B1 | 4/2001 | Whitehead et al. |
| 6,243,068 | B1 | 6/2001 | Evanicky et al. |
| 6,267,850 | B1 | 7/2001 | Bailey et al. |
| 6,268,843 | B1 | 7/2001 | Arakawa |
| 6,276,801 | B1 | 8/2001 | Fielding |
| 6,300,931 | B1 | 10/2001 | Someya et al. |
| 6,300,932 | B1 | 10/2001 | Albert |
| 6,304,365 | B1 | 10/2001 | Whitehead |
| 6,323,455 | B1 | 11/2001 | Bailey et al. |
| 6,323,989 | B1 | 11/2001 | Jacobson et al. |
| 6,327,072 | B1 | 12/2001 | Comiskey et al. |
| RE37,594 | E | 3/2002 | Whitehead |
| 6,359,662 | B1 | 3/2002 | Walker |
| 6,377,383 | B1 | 4/2002 | Whitehead et al. |
| 6,384,979 | B1 | 5/2002 | Whitehead et al. |
| 6,400,436 | B1 | 6/2002 | Komatsu |
| 6,414,664 | B1 | 7/2002 | Conover et al. |
| 6,418,253 | B2 | 7/2002 | Whitehead |
| 6,428,189 | B1 | 8/2002 | Hochstein |
| 6,435,654 | B1 | 8/2002 | Wang et al. |
| 6,437,921 | B1 | 8/2002 | Whitehead |
| 6,439,731 | B1 | 8/2002 | Johnson et al. |
| 6,448,944 | B2 | 9/2002 | Ronzani et al. |
| 6,448,951 | B1 | 9/2002 | Sakaguchi et al. |
| 6,448,955 | B1 | 9/2002 | Evanicky et al. |
| 6,452,734 | B1 | 9/2002 | Whitehead et al. |
| 6,483,643 | B1 | 11/2002 | Zuchowski |
| 6,507,327 | B1 | 1/2003 | Atherton et al. |
| 6,545,677 | B2 | 4/2003 | Brown |
| 6,559,827 | B1 | 5/2003 | Mangerson |
| 6,573,928 | B1 * | 6/2003 | Jones et al. ..... 348/51 |

| | | | |
|---|---|---|---|
| 6,574,025 | B2 | 6/2003 | Whitehead et al. |
| 6,590,561 | B1 | 7/2003 | Kabel et al. |
| 6,597,339 | B1 | 7/2003 | Ogawa |
| 6,657,607 | B1 | 12/2003 | Evanicky et al. |
| 6,680,834 | B2 | 1/2004 | Williams |
| 6,690,383 | B1 | 2/2004 | Braudaway et al. |
| 6,697,110 | B1 | 2/2004 | Jaspers et al. |
| 6,700,559 | B1 | 3/2004 | Tanaka et al. |
| 6,753,876 | B2 | 6/2004 | Brooksby et al. |
| 6,791,520 | B2 | 9/2004 | Choi |
| 6,803,901 | B1 | 10/2004 | Numao |
| 6,816,141 | B1 | 11/2004 | Fergason |
| 6,816,262 | B1 | 11/2004 | Slocum et al. |
| 6,828,816 | B2 | 12/2004 | Ham |
| 6,856,449 | B2 | 2/2005 | Winkler et al. |
| 6,864,916 | B1 | 3/2005 | Nayar et al. |
| 6,885,369 | B2 | 4/2005 | Tanahashi et al. |
| 6,891,672 | B2 | 5/2005 | Whitehead et al. |
| 6,900,796 | B2 | 5/2005 | Yasunishi et al. |
| 2001/0013854 | A1 | 8/2001 | Ogoro |
| 2001/0024199 | A1 | 9/2001 | Hughes et al. |
| 2001/0035853 | A1 | 11/2001 | Hoelen et al. |
| 2001/0038736 | A1 | 11/2001 | Whitehead |
| 2001/0048407 | A1 | 12/2001 | Yasunishi et al. |
| 2002/0003522 | A1 | 1/2002 | Baba et al. |
| 2002/0033783 | A1 | 3/2002 | Koyama |
| 2002/0036650 | A1 | 3/2002 | Kasahara et al. |
| 2002/0057253 | A1 | 5/2002 | Lim et al. |
| 2002/0063963 | A1 | 5/2002 | Whitehead et al. |
| 2002/0067325 | A1 | 6/2002 | Choi |
| 2002/0105709 | A1 | 8/2002 | Whitehead et al. |
| 2002/0135553 | A1 | 9/2002 | Nagai et al. |
| 2002/0149574 | A1 | 10/2002 | Johnson et al. |
| 2002/0154088 | A1 | 10/2002 | Nishimura |
| 2002/0159002 | A1 | 10/2002 | Chang |
| 2002/0159692 | A1 | 10/2002 | Whitehead |
| 2002/0162256 | A1 | 11/2002 | Wardle et al. |
| 2002/0171617 | A1 | 11/2002 | Fuller |
| 2002/0175907 | A1 | 11/2002 | Sekiya et al. |
| 2003/0048393 | A1 | 3/2003 | Sayag |
| 2003/0090455 | A1 | 5/2003 | Daly |
| 2003/0107538 | A1 | 6/2003 | Asao et al. |
| 2003/0132905 | A1 | 7/2003 | Lee et al. |
| 2003/0169247 | A1 | 9/2003 | Kawabe et al. |
| 2004/0012551 | A1 | 1/2004 | Ishii |
| 2004/0057017 | A1 | 3/2004 | Childers et al. |
| 2004/0239587 | A1 | 12/2004 | Murata et al. |
| 2004/0263450 | A1 | 12/2004 | Lee et al. |
| 2005/0088403 | A1 | 4/2005 | Yamazaki |
| 2005/0157298 | A1 | 7/2005 | Evanicky et al. |
| 2005/0225561 | A1 | 10/2005 | Higgins et al. |

FOREIGN PATENT DOCUMENTS

| | | | |
|---|---|---|---|
| EP | 0 829 747 | A1 | 3/1998 |
| EP | 0 606 162 | B1 | 11/1998 |
| EP | 0912047 | | 4/1999 |
| EP | 0 963 112 | A1 | 12/1999 |
| EP | 1168243 | | 1/2002 |
| EP | 1 202 244 | A1 | 5/2002 |
| EP | 1 206 130 | A1 | 5/2002 |
| EP | 1 313 066 | A1 | 5/2003 |
| EP | 1 316 919 | A2 | 6/2003 |
| EP | 1 453 030 | A1 | 9/2004 |
| FR | 2 611 389 | | 2/1987 |
| JP | 64-10299 | | 1/1989 |
| JP | 1-98383 | | 4/1989 |
| JP | 3-71111 | | 3/1991 |
| JP | 3-198026 | | 8/1991 |
| JP | 5-66501 | | 3/1993 |
| JP | 5-80716 | | 4/1993 |
| JP | 5-273523 | | 10/1993 |
| JP | 5-289044 | | 11/1993 |
| JP | 6-247623 | | 9/1994 |
| JP | 6-313018 | | 11/1994 |
| JP | 7-121120 | | 5/1995 |
| JP | 9-244548 | | 9/1997 |
| JP | 10-508120 | | 8/1998 |
| JP | 11-052412 | | 2/1999 |
| JP | 2002-099250 | | 4/2000 |
| JP | 2000-206488 | | 7/2000 |
| JP | 2000-275995 | | 10/2000 |
| JP | 2000-321571 | | 11/2000 |
| JP | 2002-091385 | | 3/2002 |
| JP | 2003-204450 | | 7/2003 |
| JP | 2003-230010 | | 8/2003 |
| JP | 3523170 | | 2/2004 |
| TW | 406206 | B | 9/2000 |
| WO | WO 91/15843 | | 10/1991 |
| WO | WO 96/33483 | | 10/1996 |
| WO | WO9808134 | | 2/1998 |
| WO | WO 00/75720 | | 12/2000 |
| WO | WO 01/69584 | | 9/2001 |
| WO | WO 02/03687 | | 1/2002 |
| WO | WO 02/079862 | | 10/2002 |
| WO | WO 03/077013 | | 9/2003 |
| WO | WO 2004/013835 | | 2/2004 |

OTHER PUBLICATIONS

T. Funamoto, T. Kobayashi, T. Murao, "High-Picture-Quality Technique for LCD televisions: LCD-AI," AVC Products Development Center, Matsushita Electric Industrial, Co., Ltd., 1-1 Matsushita-cho, Ibaraki, Osaka 567-0026 Japan, 2 pages, date unknown.

Kwak, Youngshin and MacDonald, Lindsay W., "Accurate Prediction of Colours on Liquid Crystal Displays," IS&T/SID 9TH Color Imaging Conf., pp. 355-359, 2006.

Wright, Steven L., Millman, Steven, Kodate, Manabu, "Measurement and Digital Compensation of Crosstalk and Photoleakage in High-Resolution TFTLCDs," pp. 1-12, 1999.

* cited by examiner

SYSTEM FOR REDUCING CROSSTALK

CROSS-REFERENCE TO RELATED APPLICATIONS

This is a divisional of patent application Ser. No. 10/867,958, filed Jun. 14, 2004 now U.S. Pat. No. 7,023,451, which is incorporated by reference.

BACKGROUND OF THE INVENTION

The present application relates to reducing crosstalk for a display.

A display suitable for displaying a color image usually consists of three color channels to display the color image. The color channels typically include a red channel, a green channel, and a blue channel (RGB) which are often used in additive displays such as a cathode ray tube (CRT) display and a liquid crystal display (LCD). In additive color displays, it is assumed that color primaries are additive and that the output color is the summation of its red, green, and blue channels. In order to achieve the optimal color output, the three color channels are independent from one another, i.e. the output of red channel should only dependent on the red value, not the green value or the blue value.

In cathode ray tub (CRT) displays, shadow masks are often used to inhibit electrons in one channel from hitting phosphors of other channels. In this manner, the electrons associated with the red channel primarily hit the red phosphors, the electrons associated with the blue channel primarily hit the blue phosphors, and the electrons associated with the green channel primarily hit the green phosphors. In a liquid crystal displays (LCD), a triad of three subpixels (or other configurations) is used to represent one color pixel as shown in FIG. 1. The three subpixels are typically identical in structure with the principal difference being the color filter.

The use of color triads in a liquid crystal display provides independent control of each color; but, sometimes, the signal of one channel can impact the output of another channel, which is generally referred to as crosstalk. Accordingly, the signals provided to the display are modified in some manner so that some of the colors are no longer independent of one another. The crosstalk may be the result of many different sources, such as for example, capacitive coupling in the driving circuit, electrical fields from the electrodes, or undesirable optical "leakage" in the color filters. While the optical "leakage" in the color filters can be reduced using a 3×3 matrix operation, the electrical (e.g., electrical fields and capacitive coupling) crosstalk is not reduced using the same 3×3 matrix operation.

Typical color correction for a display involves color calibration of the display as a whole using a colorimeter, and then modifying the color signals using a color matrix look up table (LUT). The same look up table is applied to each pixel of the display in an indiscriminate manner. The calorimeter is used to sense large uniform patches of color and the matrix look up table is based upon sensing this large uniform color patch. Unfortunately, the resulting color matrix look up table necessitates significant storage requirements and is computationally expensive to compute. It is also inaccurate since it ignores the spatial dependence of crosstalk (i.e. correcting for the color of low frequencies causes high frequency color inaccuracies).

BRIEF SUMMARY OF THE INVENTION

Not applicable.

DETAILED DESCRIPTION OF PREFERRED EMBODIMENT

Figure 1:
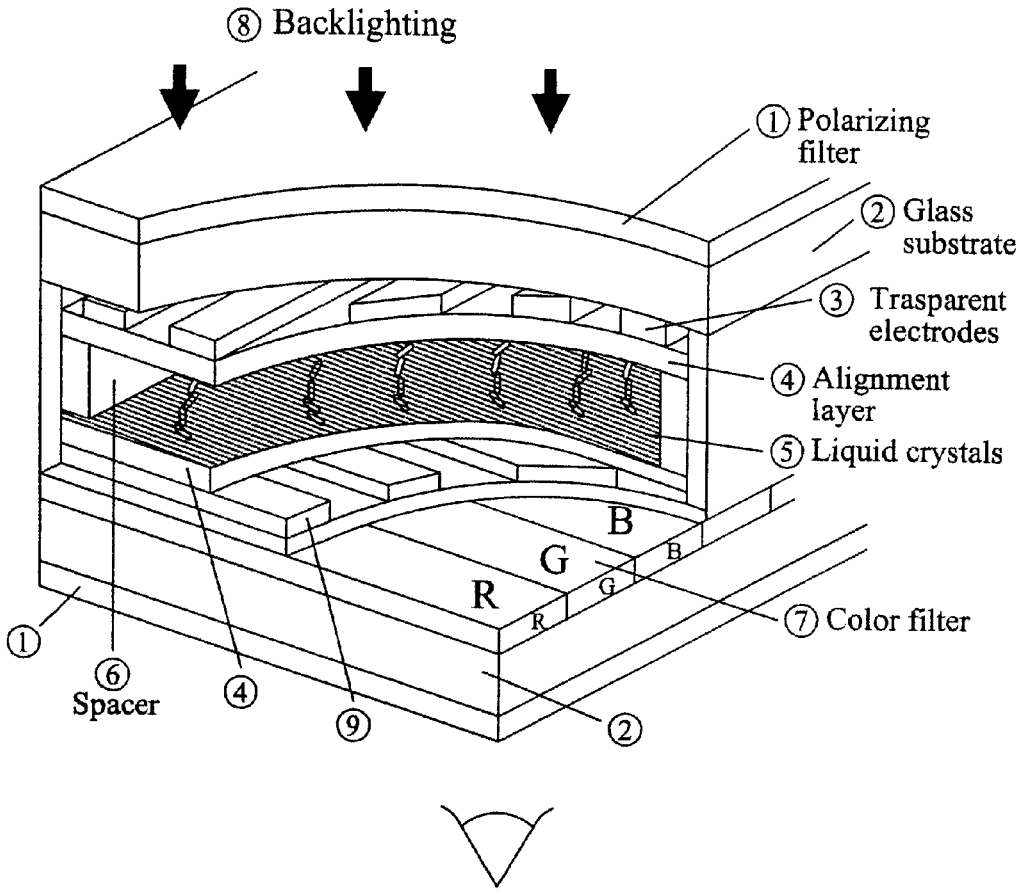
FIG. 1 illustrates the structure of a color TFT LCD.
Figure 2:
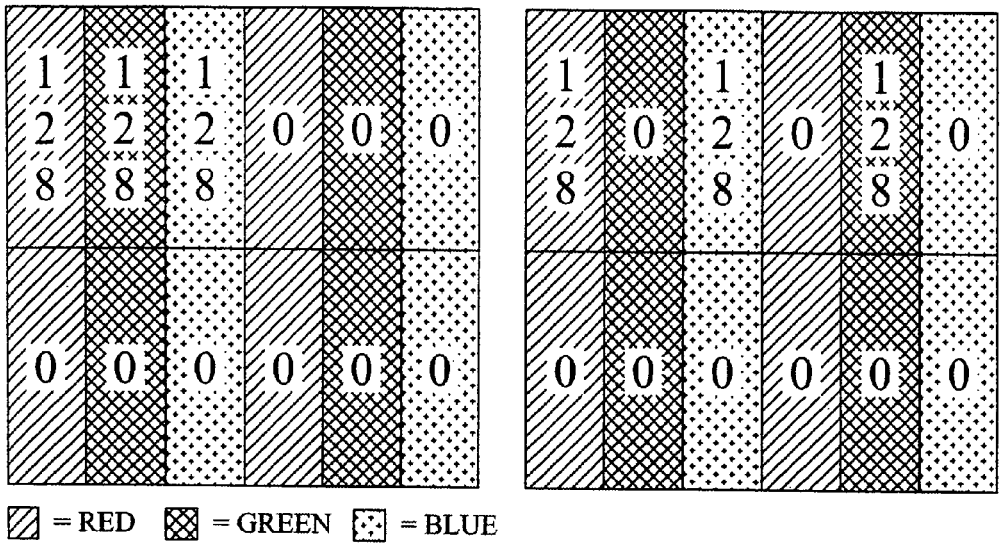
FIG. 2 illustrates two patterns of the same average color value.

After consideration of the color matrix look up table resulting from using a colorimeter sensing large uniform color patches, the present inventor came to the realization that the results are relatively inaccurate because it inherently ignores the spatial dependence of crosstalk. For example, by correcting for the color inaccuracies of color patches (e.g., low frequencies), it may actually result in color inaccuracies of a more localized region (e.g., high frequencies). By way of example, FIG. 2 shows two patterns having the same average color value for a 2×2 set of pixels, with each pixel having three subpixels, such as red, green, and blue. If crosstalk exists, the signal values are modified to reduce the crosstalk between the three color channels. The display may include one or more different color channels, with crosstalk between one or more of the different channels, the channels may be the same or different color, all of which uses any pixel or subpixel geometry. As previously noted, in existing color patch based crosstalk reduction techniques the pixel value is changed without considering the spatial relationship between the pixels, and thus both patterns of FIG. 2 are modified. However, it may be observed that the pattern on the right side of FIG. 2 does not likely need any correction since there is an "off" subpixel between any of two "on" subpixels. The "off" pixel (e.g., imposing zero voltage on the pixel electrodes) has no effect on the "on" pixel (e.g., imposing a voltage on the pixel electrodes), and vise versa since there is no corresponding electrical impact. The "off" pixel may have a voltage imposed thereon, and the "on" pixel not having a voltage imposed thereon, depending on the type of display. The off voltage may be zero or substantially zero (e.g., less than 10% of maximum voltage range of pixel*).

Figure 3:
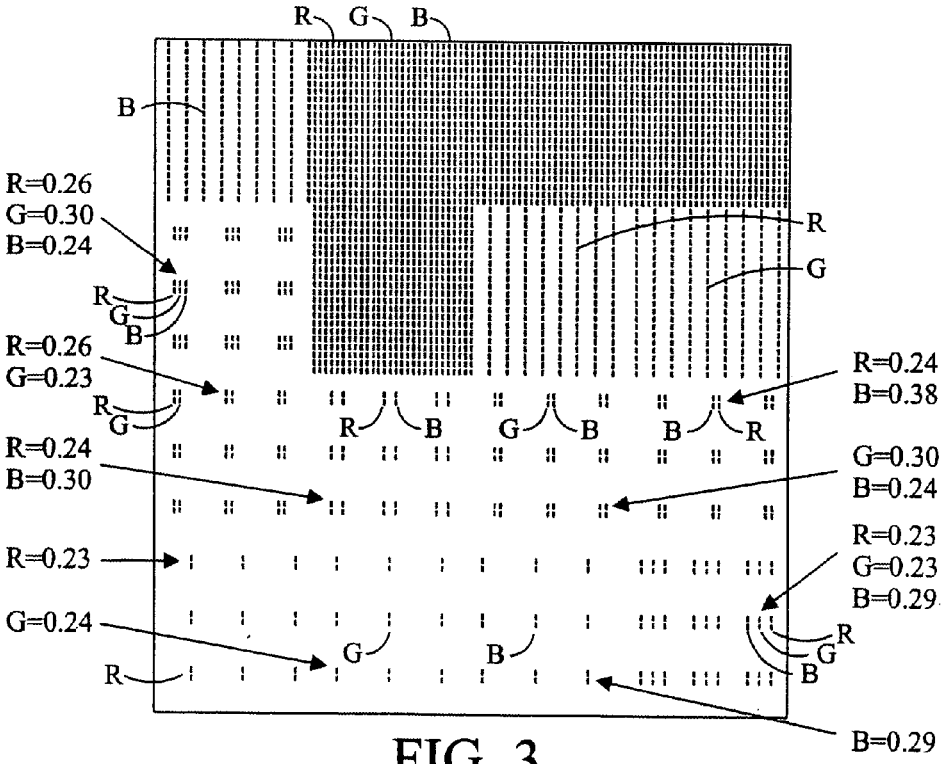
FIG. 3 illustrates a LCD with crosstalk between subpixels.

One technique to overcome this spatial crosstalk limitation is to use a subpixel based modification technique. The subpixel technique may be applied in a manner that is independent of the particular image being displayed. Moreover, the subpixel technique may be applied in a manner that is not dependent on the signal levels. A test may be performed on a particular display or display configuration to obtain a measure of the crosstalk information. Referring to FIG. 3, a micro-photograph of a liquid crystal display with various subpixel arrangements is illustrated. The subpixel values of the display in this illustration are either 0 (or substantially zero, such as less than 10% of the voltage range) or 128 (or near 128, such as within 10% of maximum of the voltage range). After performing this test, it was observed that (1) substantial crosstalk is observed when any two neighboring subpixels are on; (2) no substantial crosstalk is observed when subpixels are separated by an "off" subpixel; (3) the crosstalk is directional, such as from right to left but not left to right; and (4) there is no substantial crosstalk in a vertical direction. If desired, the crosstalk reduction technique may be free from reducing crosstalk in the vertical direction. If desired, the cross talk reduction technique may be applied in a single direction, in two directions, or in multiple directions.

Based upon these observations the present inventor was able to determine that an appropriate crosstalk reduction technique preferably incorporates a spatial property of the display, since the underlying display electrode construction and other components have a spatial property which is normally repeated in a relatively uniform manner across the display. The spatial property may be, for example, based upon a spatial location within the display, a spatial location within a sub-pixel, the location of a pixel within a display, and the spatial location within the display, sub-pixel, and/or pixel location relative to another spatial location within the display, sub-pixel, and/or pixel location.

Figure 4:
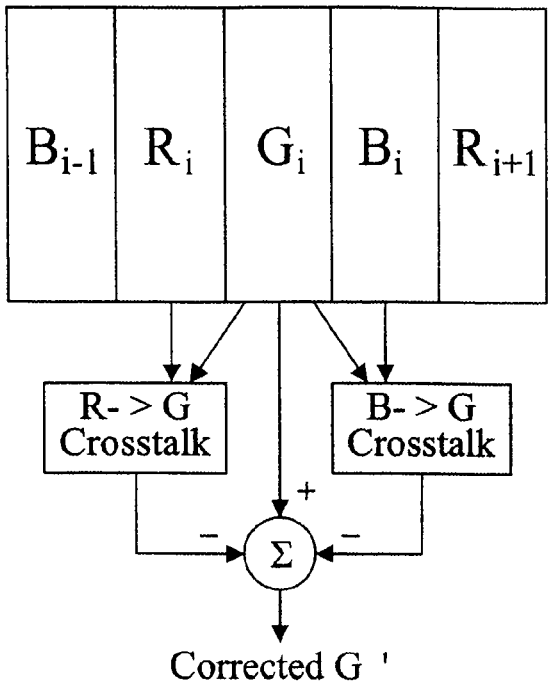
FIG. 4 illustrates crosstalk corrections in a subpixel grid.

Based on these properties, the correction technique preferably has a spatial property, and more preferably operating on the subpixel grid. The value of each subpixel should be adjusted primarily based on the value of its horizontal neighboring subpixels. FIG. 4 illustrates the crosstalk correction for the green subpixel $G_i$. The crosstalk from left subpixel (red to green) is calculated based the pixel value of red and green, and the crosstalk from right subpixel (blue to green) is calculated based the pixel value of blue and green. These two crosstalk amounts are subtracted from the green value. For the red pixel, since it borders with the blue subpixel of the left pixel ($B_{i-1}$), its crosstalk should be derived from $B_{i-1}$ and $G_i$. For the same reason, the crosstalk for the blue pixel should be derived from $G_i$ and $R_{i+1}$. The crosstalk correction can be mathematically represented in the following equations:

$$R_i'=R_i-f_l(B_{i-1},R_i)-f_r(G_i,R_i)$$

$$G_i'=G_i-f_r(R_i,G_i)-f_r(B_i,G_i)$$

$$B_i'=B_i-f_r(G_i,B_i)-f_l(R_{i+1},B_i)$$

where $f_l$ is crosstalk correction from left and $f_r$ is crosstalk from right. "f" is a function of subpixel value and its bordering subpixels. A prime mark (') is used to denote the modified value.

Figure 5:
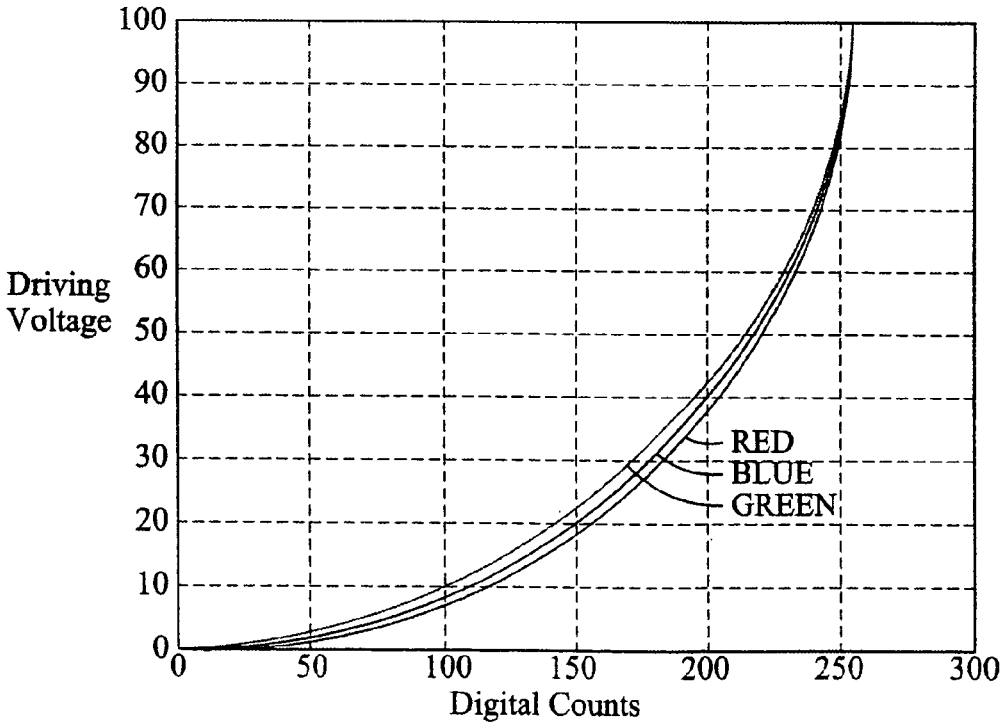
FIG. 5 illustrates digital counts to voltage curve.

Since the principal source of crosstalk is electrical coupling, the correction is preferably performed in the driving voltage space. Performing correction in the voltage space also reduces dependence of display gamma table, which is often different between the RGB channels. Therefore, making an adjustment in a substantially linear domain or otherwise a non-gamma corrected domain is preferable. FIG. 5 shows an example of digital count to voltage relationship, where the three curves represent the response function of three color channels. The RGB signal is first converted to driving voltage using three one dimensional (1D) look up tables (LUTs).

Once the input RGB signal is converted to voltage, there is no difference between the color channels. The crosstalk in the preferred embodiment is only dependent on the voltage as well as the voltages of its two immediate neighbors. Because crosstalk is in many cases non-linear, a two dimensional LUT is more suitable for crosstalk correction, with one entry to be the voltage of the current pixel and the other is the voltage of its neighbor. The output is the crosstalk voltage which should be subtracted from the intended voltage. In general, two two-dimensional LUTs are used, one for crosstalk from the left subpixel, and the other for the crosstalk from the right subpixel. It is observed that, in some LCD panels, crosstalk is directional in one direction is too small to warrant a correction, thus only one two-dimensional LUT is needed.

Figure 6:
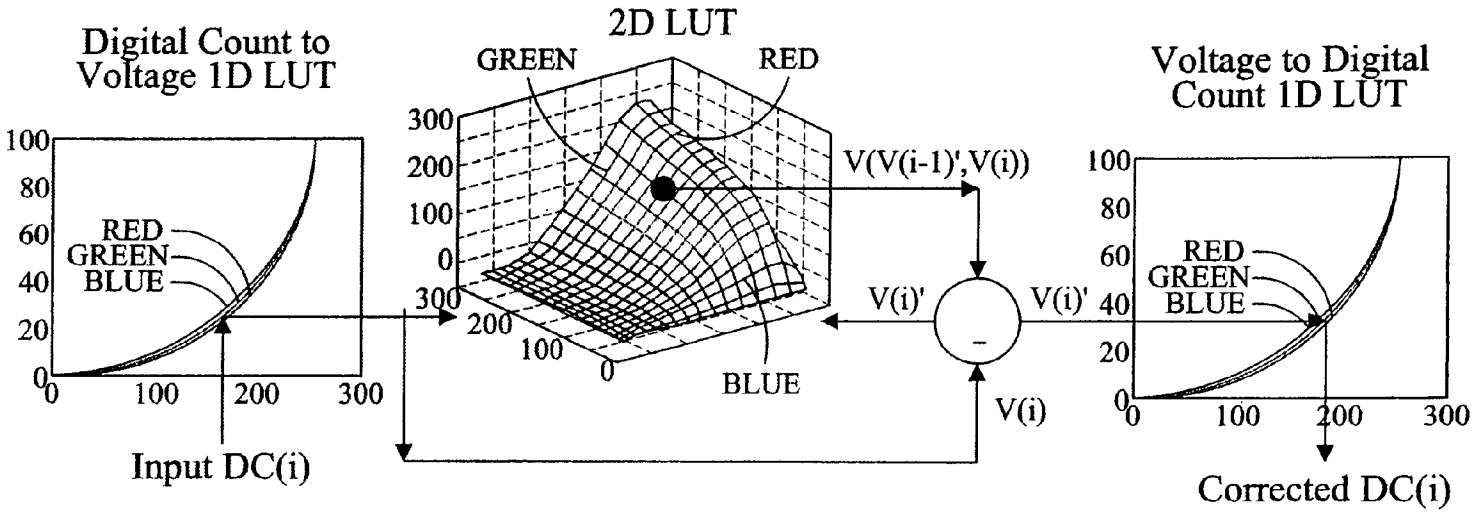
FIG. 6 illustrates crosstalk correction using a two-dimensional look up table.

The process of crosstalk correction may be illustrated by FIG. 6 and further described below:

Step 1: For each pixel the input digital count is converted to LCD driving voltage V(i) using the one dimensional LUT of that color channel.

Step 2: Using this voltage and the voltage of previous pixel V(i−1) (for crosstalk from the left pixel, the voltage of the left subpixel is used, and for crosstalk from the right pixel, the voltage of the right subpixel is used), a crosstalk voltage is looked up from the two-dimensional LUT as dV(V(i−1)',V(i)).

Step 3: Correct the output voltage V(i)'=V(i)−dV(V(i−1)',V(i))

Step 4: The voltage is converted to digital count using the voltage-to-digital count 1D LUT.

Step 5: Set the previous pixel voltage V(i−1)' to the current newly corrected voltage V(i)'.

Step 5: Set the previous pixel voltage V(i−1)' to the current newly corrected voltage V(i)'.

$$I=I+1$$

Repeat step 1-5.

Once a line is corrected for one direction (e.g. crosstalk from the left subpixel), the technique may proceed to the other direction. For the right to left crosstalk, since the crosstalk correction depends on the value of the previous subpixel voltage, crosstalk correction is preferably performed from right to left. For many displays, only crosstalk in one direction is significant, thus the second pass correction can be omitted.

Figure 7:
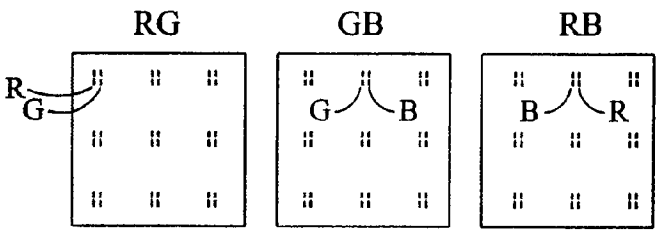
FIG. 7 illustrates patterns that may be used to measure crosstalk.

The two-dimensional LUT may be constructed using the following steps:

1. Display patterns of two subpixel patterns as shown in FIG. 7, with all the combination of intensity, i.e. R=min to max, and G=min to max.
2. Measured these color patch using a color measuring device such as a spectrophotometer to get the XYZ.
3. Subtract the dark leakage XYZ, convert XYZ to RGB using a 3×3 matrix $$XYZ2RGB=\begin{vmatrix} X_r & X_g & X_b \\ Y_r & Y_g & Y_b \\ Z_r & Z_g & Z_n \end{vmatrix}^{-1}$$

where X, Y, Z is the measured colorimetric values of the three primary: R, G, and B at its max intensity.

4. Convert RGB to voltage using LCD's voltage to transmittance relationship.
5. Calcuate the crosstalk, e.g.
   Left to right: rgCrosstalk(r,g)=V(r,g)−V(0,g),
   Right to left: grCrosstalk(r,g)=V(r,g)−=V(0,g).
6. Average the crosstalk measurement using rg, gb and rb patterns as shown FIG. 7 to construct a two-dimensional table of crosstalk voltage dV as a function of voltage V(i) and its neighboring voltage V(i−1)'.

7. Construct two two-dimensional LUTs of crosstalk voltage by linearly interpolating the data measure in step 6. One table for left subpixel crosstalk and the other for the right subpixel crosstalk. There are two entries for the two-dimensional LUTs: one entry to be the desired voltage V(i), and the other to be the voltage of its neighboring subpixel V(i−1)'. The table contents or output are the crosstalk voltages dV(V(i), V(i−1)).

The size of the table is a tradeoff between accuracy and memory size. Ideally 10 bit are used to represent voltages of 8 bit digital counts, but the crosstalk voltage is a secondary effect, thus less bits are needed to achieve the correction accuracy. In the preferred embodiment, 6-bits (most significant bits) are used to represent the voltages, resulting in the table size of 64×64.

In the preferred embodiment, two-dimensional look up tables are used to calculate the amount of crosstalk. This can be implemented with a polynomial functions. The coefficients and order of polynomial can be determined using polynomial regression fit. The advantage of polynomial functions is smaller memory requirement that only the polynomial coefficients are stored. The drawback is computation required to evaluate the polynomial function.

For the simplest form of crosstalk due to capacitance coupling, the crosstalk is only proportional to the crosstalk voltage V(i−1)', a polynomial fit becomes a linear regression. Then corrected voltage is given by $$V(i)'=V(i)-k_l*V(i-1)'-k_r*V(i+1)'$$

where $k_l$ and $k_l$ are the crosstalk coefficients from left and right. This is essentially an infinite impulse response (IIR) filtering. Since the V(i−1)' is very close to V(i−1), V(i−1)' can be approximated with V(i−1). The same is true for V(i+1)'. The correction can be modeled as finite impulse response function, i.e.

$$V(i)'=V(i)-k_l*V(i-1)-k_r*V(i+1)=V\hat{\times}[-k_r,\ 1,\ k_l]$$

where $\hat{\times}$ denotes the convolution operation.

In the preferred embodiment, RGB digital counts are converted to voltage, and crosstalk correction is done in voltage space. This allows all three channels to use the same two dimension LUTs. An alternative to this is to perform crosstalk correction in the digital count domain as shown in FIG. 4. Most likely, three sets of two dimensional LUTs are required resulting a larger memory requirement. The advantage is less computation due to the fact that the two one-dimensional LUTs in FIG. 6 are no longer needed.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A method of modifying an image to be displayed on a 2-dimensional display so as to reduce crosstalk within said image, said method comprising the steps of:

(a) receiving an image having data representative of pixels, each pixel including a plurality of subpixels, each said subpixel of a respective pixel displaying a uniform color different from those displayed by the other subpixels of said respective pixel;

(b) modifying the intensity value of a subpixel of a respective pixel based upon, at least in part, the intensity value of another subpixel of said respective pixel; and (c) wherein said another subpixel is selected based upon a spatial relationship of said another subpixel to said subpixel.

2. The method of claim 1 wherein said image is represented by co-sited multi-colored pixels.

3. The method of claim 1 wherein said image is displayed on a display having spatially separated sub-pixels comprising a single pixel.

4. The method of claim 3 wherein said sub-pixels are red, green, and blue.

5. The method of claim 3 wherein said display is a liquid crystal display.

6. The method of claim 1 wherein said one of said subpixels is free from being modified if at least one adjoining subpixel has substantially zero voltage imposed thereon.

7. The method of claim 6 wherein said one adjoining subpixel is off.

8. The method of claim 1 wherein said modifying is independent of said image to be displayed.

9. The method of claim 1 wherein said modifying is free from being dependent on the signal levels of said image.

10. The method of claim 1 wherein said spatial relationship is the spatial location within said display.

11. The method of claim 1 wherein said spatial relationship is a spatial location within a subpixel.

12. The method of claim 1 wherein said spatial relationship is the location of a pixel within said display.

13. The method of claim 1 wherein said spatial relationship is the position of said one subpixel to said another subpixel.

14. The method of claim 1 wherein said one of said subpixels and said another one of said subpixels are horizontally displaced.

15. The method of claim 14 wherein said one of said subpixels and said another one of said subpixels are adjacent one another.

16. The method of claim 1 wherein said modifying is represented by:

$$R_i'=R_i-f_l(B_{i-1},R_i)-f_r(G_i,R_i)$$

$$G_i'=G_i-f_r(R_i,G_i)-f_r(B_i,G_i)$$

$$B_i'=B_i-f_r(G_i,B_i)-f_l(R_{i+1},B_i)$$

where $f_l$ is crosstalk correction from left and $f_r$ is crosstalk from right, "f" is a function of subpixel value and its bordering subpixels, and a prime mark denotes the modified value.

17. The method of claim 1 wherein said modifying is in a substantially linear domain.

18. The method of claim 1 wherein said modifying is in a non-gamma corrected domain.

19. The method of claim 1 wherein said modifying includes a different profile for each color channel.

20. The method of claim 19 wherein each of said different profiles is represented by a look-up table.

21. The method of claim 19 wherein each of said different profiles is represented by a function.

22. The method of claim 1 wherein said modifying includes a two-dimensional look up table.

23. The method of claim 22 wherein said modifying includes two two-dimensional look up tables.

24. The method of claim 1 further comprising converting a plurality of pixel values of said image to a driving voltage using a corresponding look up table.

25. The method of claim 24 further comprising using said driving voltage for a plurality of subpixels.

26. The method of claim 25 wherein said plurality of subpixels are horizontally displaced from one another.

27. The method of claim 26 wherein said plurality of subpixels are free from being vertically displaced from one another.

28. The method of claim 25 wherein said modifying is based upon said driving voltage.

29. The method of claim 28 wherein said modifying includes converting said driving voltage to a digital count.

30. The method of claim 29 wherein said converting is based upon a look up table.

31. The method of claim 30 wherein the value of said one of said plurality of subpixels is modified based upon said converting.

* * * * *

UNITED STATES PATENT AND TRADEMARK OFFICE

CERTIFICATE OF CORRECTION

PATENT NO. : 7,342,592 B2
APPLICATION NO. : 11/330956
DATED : March 11, 2008
INVENTOR(S) : Xiao-Fan Feng It is certified that error appears in the above-identified patent and that said Letters Patent is hereby corrected as shown below:

Col. 4, lines 51-54

Change "$XYZ2RGB = \begin{vmatrix} X_r & X_g & X_b \\ Y_r & Y_g & Y_b \\ Z_r & Z_g & Z_n \end{vmatrix}^{-1}$"

to --$XYZ2RGB = \begin{vmatrix} X_r & X_g & X_b \\ Y_r & Y_g & Y_b \\ Z_r & Z_g & Z_b \end{vmatrix}^{-1}$--.

Signed and Sealed this

Nineteenth Day of August, 2008

JON W. DUDAS
*Director of the United States Patent and Trademark Office*